US011953284B2

(12) United States Patent
Davis

(10) Patent No.: US 11,953,284 B2
(45) Date of Patent: Apr. 9, 2024

(54) MODULAR QUIVER SYSTEM AND METHOD OF USE

(71) Applicant: Steven William Davis, Vincennes, IN (US)

(72) Inventor: Steven William Davis, Vincennes, IN (US)

(73) Assignee: QUICK DRAW LLC, Vincennes, IN (US)

( * ) Notice: Subject to any disclaimer, the term of this patent is extended or adjusted under 35 U.S.C. 154(b) by 0 days.

(21) Appl. No.: 17/365,688

(22) Filed: Jul. 1, 2021

(65) Prior Publication Data

US 2022/0003517 A1 Jan. 6, 2022

Related U.S. Application Data

(60) Provisional application No. 63/048,040, filed on Jul. 3, 2020.

(51) Int. Cl.
*F41B 5/06* (2006.01)

(52) U.S. Cl.
CPC ..... *F41B 5/066* (2013.01)

(58) Field of Classification Search
CPC .. F41B 5/10; F41B 5/148; F41B 5/123; F41B 5/12; F41B 5/00; F41B 5/1461; F41B 5/1484; F41B 5/06; F41B 5/063; F41B 5/066
See application file for complete search history.

(56) References Cited

U.S. PATENT DOCUMENTS 2,816,696 A * 12/1957 Stockfleth ..... F41B 5/066 414/916
2,997,999 A * 8/1961 Crowder ..... F41B 5/066 124/25.7
3,116,730 A * 1/1964 Tingley ..... F41B 5/066 224/916
3,696,978 A * 10/1972 Gentellalli ..... F41B 5/063 124/25.7
3,840,944 A * 10/1974 Gresley ..... F41B 5/14 124/25.7
4,156,496 A * 5/1979 Stinson ..... F41B 5/066 124/25.7
4,195,616 A * 4/1980 Darlington ..... F41B 5/066 124/25.7
4,247,027 A * 1/1981 Tardiff ..... F41B 5/066 124/25.7
4,252,101 A * 2/1981 Spitzke ..... F41B 5/066 224/916

(Continued)

*Primary Examiner* — Melba Bumgarner
*Assistant Examiner* — Amir A Klayman
(74) *Attorney, Agent, or Firm* — Brannon Sowers & Cracraft PC

(57) ABSTRACT

A modular quiver system and method of use may include, first, a base portion configured to be attachable to a bow and configured to removably hold a first arrow, and second, a detachable portion configured to removably hold a plurality of second arrows and configured to be removably attachable with the base portion by hand without the use of any tools, regardless whether or not the base portion is attached to the bow, and regardless whether arrows are in the quiver. A quick-release bracket system allows the modular quiver system to be removed from and attached with a bow in different predetermined positions without the use of any tools.

11 Claims, 9 Drawing Sheets

(56) References Cited

U.S. PATENT DOCUMENTS 4,363,312 A * 12/1982 Spitzke ..... F41B 5/066 124/25.7
4,621,606 A * 11/1986 Toth ..... F41B 5/066 124/24.1
4,785,791 A * 11/1988 Sloop ..... F41G 1/467 124/25.5
4,788,961 A * 12/1988 Toth ..... F41B 5/066 124/25.5
4,805,584 A * 2/1989 Stinson ..... F41B 5/066 224/916
4,995,372 A * 2/1991 Topel ..... F41B 5/066 124/25.5
5,076,522 A * 12/1991 Stinson ..... F41B 5/06 248/217.4
5,775,314 A * 7/1998 Michael ..... F41B 5/066 124/86
6,105,566 A * 8/2000 Tiedemann ..... F41B 5/066 124/25.7
6,666,204 B1 * 12/2003 Hedrick ..... F41B 5/066 124/25.5
6,672,299 B2 * 1/2004 Proctor ..... F41B 5/066 124/86
6,725,853 B2 * 4/2004 Foddrill ..... F41B 5/066 124/25.5
7,775,201 B2 * 8/2010 Cooper ..... F41B 5/14 124/86
7,980,239 B1 * 7/2011 Parmer, Sr. ..... F41B 5/066 124/86
7,987,842 B2 * 8/2011 McPherson ..... F41B 5/066 124/86
8,061,341 B2 * 11/2011 Hudkins ..... F41B 5/066 124/25.7
8,505,527 B2 * 8/2013 Kempf ..... F41B 5/066 124/86
8,714,147 B2 * 5/2014 Walk ..... F41B 5/066 224/916
8,899,221 B2 * 12/2014 Barnett ..... F41B 5/066 224/916
8,931,469 B2 * 1/2015 Kingsbury ..... F41B 5/066 124/88
9,372,045 B1 * 6/2016 Kempf ..... F41B 5/066
9,400,153 B2 * 7/2016 Evans ..... F41B 5/066
10,591,243 B2 * 3/2020 Houle ..... F41B 5/066
2007/0221588 A1 * 9/2007 Notestine ..... F41B 5/06 211/13.1
2016/0018182 A1 * 1/2016 Pedersen ..... B23P 15/00 124/86

* cited by examiner

FIG. 4A
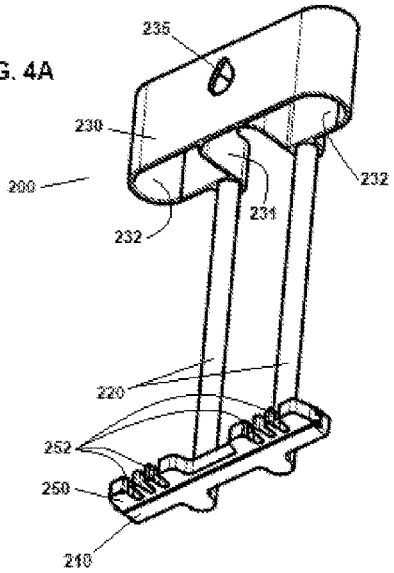
FIG. 4B
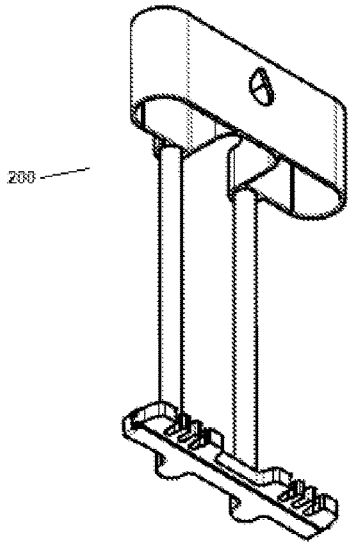
FIG. 4C
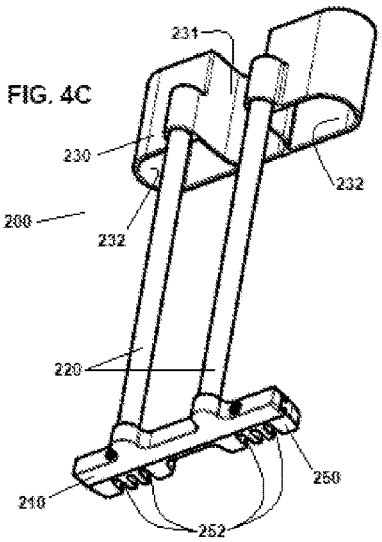
FIG. 4D
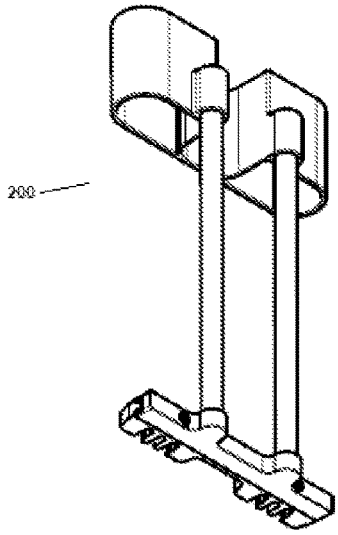
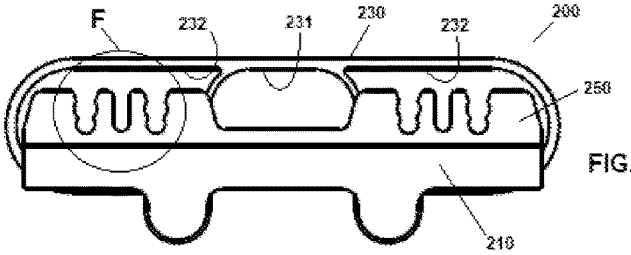
FIG. 4E
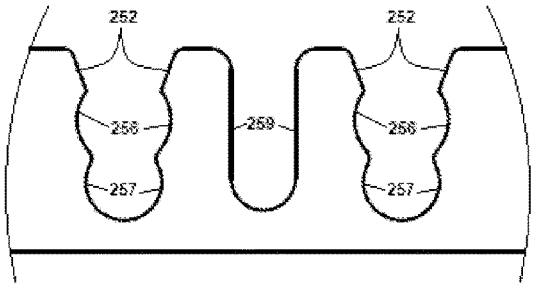
FIG. 4F

MODULAR QUIVER SYSTEM AND METHOD OF USE

CROSS-REFERENCE TO RELATED APPLICATIONS

This application claims priority to, incorporates herein by reference, and is a non-provisional of U.S. provisional patent application Ser. No. 63/048,040 to Steven William Davis, entitled Modular Quiver System and Method of Use, which was filed Jul. 3, 2020.

FEDERALLY SPONSORED RESEARCH OR DEVELOPMENT

None.

TECHNICAL FIELD

The present invention relates to the field of archery, and more particularly to bow-mountable arrow quivers.

BACKGROUND

The present inventor began his archery career in about 1982 shooting a recurve bow. In about 1984 he began deer hunting with modern archery equipment, which typically includes a quiver attached to the bow for holding multiple arrows so that the archer can readily shoot multiple arrows successively. His first quiver for holding arrows was a Kwikee Kwiver® brand quiver. In about 2011 the present inventor used a Soft Loc™ brand quiver. Up until inventing the present quiver he was using a Trophy Ridge® brand quiver for his hunting bow.

But the present inventor experienced problems with these conventional quivers when he began using a heavy forward-of-center (FOC) hunting system, which significantly increased the arrow weight from about 450 grains to 680 or more grains per arrow. This additional weight became burdensome with a full quiver of arrows, causing significant changes in weight distribution and leading to arm fatigue and less accurate shots. Accordingly, the present inventor, like many hunters, occasionally detached his quiver from his bow while hunting to restore balance to the bow, reduce fatigue, and improve accuracy. But with the quiver detached from the bow, an archer is unable to shoot multiple arrows successively without engaging in much more movement, removing their eyes from the target, and using one (or both) hands to search for and retrieve each additional arrow separately for each follow-up shot. That is a problem for hunters, because often hunters must quickly shoot a second "follow-up" shot without taking their eyes off the target in order to effectuate an ethical kill. Therefore, in many cases the present inventor left his bulky quiver attached to his bow with only a single arrow in the quiver to facilitate easy one-handed retrieval of a second arrow essential for the follow-up shot. But this meant that he had to find somewhere else to carry the rest of his arrows, which essentially defeated the purpose of the quiver.

The present inventor looked for a workable solution to this problem in existing products but found none. For example, U.S. Pat. No. 8,714,147 B2 to Walk et al., entitled Modular Quiver Apparatus and Method, issued May 6, 2014 ("Walk et al."), which is incorporated herein by reference in its entirety, disclosed a quiver that could be mechanically adjusted to multiple configurations to hold different numbers of arrows. But Walk et al. would not solve the problem the present inventor had identified, because Walk et al. would not be useful to selectively choose how many arrows to carry at any given time in the field, since it had to be laboriously taken apart and reassembled with fasteners and different components to change between configurations. Additionally, the disassembled portions of Walk et al. would presumably not hold arrows during or after disassembly. The present inventor decided there needed to be a better way to solve the problem he had identified.

SUMMARY

The present invention provides novel apparatus and methods of use for bow-mountable arrow quivers (referred to herein simply as "quivers"), which improve over known systems and provide numerous additional benefits as will be appreciated by persons of skill in the art upon reviewing this disclosure. For example, provided in various example embodiments is a multi-part modular detachable quiver system where a user can attach the full quiver system to a bow and load the quiver system with arrows, so that the bow with its fully-loaded quiver system attached thereto can be carried as one piece, for instance to and from a hunting location. Then once the user is located at a hunting or other arrow-shooting location, the user can detach a detachable portion of the quiver system from the bow without using any tools, for instance a detachable portion containing all but one of the arrows in the quiver system (or any other suitable number of arrows in various alternative example embodiments), thereby leaving a base portion of the quiver system still attached to the bow, the base portion of the quiver system containing a single arrow (or any other suitable number of arrows in various alternative example embodiments). The user can then hunt or otherwise shoot the bow with an arrow in-hand, as well as with a single back-up arrow in the base portion of the quiver system still attached to the bow, thereby leaving the back-up arrow available for one-handed easy retrieval for a follow-up shot without causing additional movement or causing the user to take their eyes off the target, while also alleviating strain caused by the additional weight of the full quiver system and improving shot accuracy. In the meantime, the detached detachable portion of the quiver system continues to retain the remaining arrows for access between shots. Then when the user moves to a different location or otherwise wants to gather the hardware together, the user can, again without using any tools, reattach the detachable portion of the quiver system with the base portion of the quiver system that is attached to the bow. Alternatively, the entire quiver system, including the detachable portion attached with the base portion, can be attached with and removed from the bow together as one-piece.

For example, provided in various example embodiments is a multi-part modular quiver system comprising a base portion and a detachable portion, the base portion fixedly attachable to a bow, for instance mountable with fasteners to a standard quiver mounting bracket on a bow, and configured to hold a first arrow for use in making a follow-up shot. The detachable portion may be configured to hold a plurality of second arrows and may be removably attachable with the base portion by hand without using any tools.

In various example embodiments the detachable portion may be configured to be removably attachable with the base portion by hand without using any tools regardless whether or not the first and/or second arrows are positioned in the base portion and/or the detachable portion. In various example embodiments the detachable portion may be configured to be removably attachable with the base portion by hand without using any tools by the multi-part modular quiver system comprising first engagement members on the base portion, and by comprising correspondingly positioned second engagement members on the detachable portion, such that the first and second engagement members are configured to engage with each other in a fixed manner when pushed together by the hands of a user, and the first and second engagement members are further configured to disengage from each other when pulled apart by the hands of the user. In various example embodiments the first engagement members or the second engagement members or both may comprise flexible structures. In various example embodiments the first engagement members may comprise resilient concavities and the second engagement members may comprise correspondingly positioned longitudinally extending cylindrical bars, such that the resilient concavities are configured to deflect around and removably engage with corresponding ones of the longitudinally extending cylindrical bars.

In various example embodiments the multi-part modular quiver system may be configured so that the plurality of second arrows are positioned on opposite sides of the first arrow when the detachable portion is removably attached to the base portion. In various example embodiments the base portion of the multi-part modular quiver system may comprise a first hood portion configured to receive and removably retain therein an arrowhead portion of the first arrow, and the detachable portion of the multi-part modular quiver system may comprise one or more second hood portions configured to receive and removably retain therein arrowhead portions of the second arrows. In various example embodiments the first and second hood portions may be sized, shaped, and positioned so that the first hood portion is nested within or between one or more second hood portions when the detachable portion is removably attached to the base portion and the plurality of second arrows are positioned on opposite sides of the first arrow.

In various example embodiments the base portion may comprise hangable structure configured sufficiently robustly to reliably support the freely hanging weight of the multi-part modular quiver system with the bow attached thereto. In various example embodiments the hangable structure may comprise a bracket defining a hole therethrough configured to hang on a hook, branch, or similar structure or protrusion. In various example embodiments the hangable structure may comprise a loop configured to hang on a hook, branch, or similar structure or protrusion.

Accordingly, provided in various example embodiments is a modular quiver system, comprising: a base portion configured to be attachable to a bow and configured to removably hold a first arrow; and a detachable portion configured to removably hold a plurality of second arrows and configured to be removably attachable with the base portion by hand without the use of any tools regardless whether or not the base portion is attached to the bow.

In various example embodiments the base portion further comprises first engagement members and the detachable portion further comprises second engagement members, the first and second engagement members configured and positioned to engage with each other in a fixed manner when pushed together by a user's hands, and the first and second engagement members further configured to disengage from each other when pulled apart by the user's hands. In various example embodiments the first engagement members comprise flexible and resilient structures, which may comprise concavities. In various example embodiments each first engagement member may comprise a first flexible and resilient concavity opening toward a first longitudinal direction and a second flexible and resilient concavity opening toward a second longitudinal direction, such that the first and second longitudinal directions are perpendicular to each other. In various example embodiments the second engagement members may comprise longitudinally extending cylindrical bars positioned correspondingly to the first engagement members, such that the flexible and resilient concavities are configured to deflect around and removably engage with corresponding ones of the longitudinally extending cylindrical bars. In various example embodiments the plurality of second arrows are positioned on opposite sides of the first arrow when the detachable portion is removably attached to the base portion. In various example embodiments the base portion comprises a first hood portion configured to receive and removably retain therein an arrowhead portion of the first arrow, and the detachable portion comprises one or more second hood portions configured to receive and removably retain therein arrowhead portions of the second arrows, the first and second hood portions are sized, shaped, and positioned so that the first hood portion is nested interstitially among the one or more second hood portions when the detachable portion is removably attached to the base portion and the plurality of second arrows are positioned on opposite sides of the first arrow. In various example embodiments the base portion comprises hangable structure configured sufficiently robustly to hang the bow from when the modular quiver system is attached to the bow. In various example embodiments the hangable structure comprises a hole formed in a hood portion of the base portion, the hood portion configured to receive and removably retain therein an arrowhead portion of the first arrow. In various example embodiments the detachable portion comprises hangable structure configured sufficiently robustly to hang the bow from when the modular quiver system is attached to the bow. In various example embodiments the hangable structure comprises a hole formed in a hood portion of the detachable portion, the hood portion configured to receive and removably retain therein arrowhead portions of the second arrows.

In various example embodiments the modular quiver system may further comprise a quick-release bracket configured to be attached to the bow and configured for a user to removably engage the base portion with the quick-release bracket without the use of tools, regardless whether or not the detachable portion is attached with the base portion and regardless whether or not the base portion or the detachable portion or both are removably holding arrows. In various example embodiments the base portion comprises a plurality of projections sized, shaped, and positioned to removably engage with slots in the quick-release bracket. In various example embodiments the modular quiver system may be further configured to be selectably attached to the bow in different positions depending on which of the projections are removably engaged with the slots in the quick-release bracket. In various example embodiments the modular quiver system may further comprise a first slot in the quick-release bracket extending in a first longitudinal direction and a second slot in the quick-release bracket extending in a second longitudinal direction, such that the first and second longitudinal directions are perpendicular to each other.

Also provided in various example embodiments is a bow comprising a modular quiver system as described herein attached thereto. While a bow is not shown in the present figures, examples of bows are shown in one or more of the references incorporated herein by reference.

Further provided in various example embodiments is a method comprising the following steps: providing a bow; providing a modular quiver system as described herein; and attaching the modular quiver system with the bow. In various example embodiments the method may further comprise the steps of removing the detachable portion from the base portion while the base portion is attached to the bow. In various example embodiments the method may further comprise the steps of removing the detachable portion from the base portion while the base portion is attached to the bow and is removably holding a first arrow, and while the detachable portion is removably holding a plurality of second arrows.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples shall not in any way to limit, define or otherwise establish the scope of legal protection.

BRIEF DESCRIPTION OF THE DRAWINGS

FIGS. 1A through 8B illustrate certain aspects of example modular quiver systems and methods of use according to certain example embodiments, wherein:

FIG. 1A is a bottom back side perspective view of a first example base portion of a multi-part modular detachable quiver system, depicting in dashed lines for reference an arrow removably stored therein;

FIG. 4A is a front right side perspective view of a first example detachable portion of a multi-part modular detachable quiver system according to various example embodiments;

FIG. 4B is a front left side perspective view of the example detachable portion of FIG. 4A;

FIG. 4C is a rear left side perspective view of the example detachable portion of FIG. 4A;

FIG. 4D is a rear right side perspective view of the example detachable portion of FIG. 4A;

FIG. 4E is a bottom elevation view of the example detachable portion of FIG. 4A;

FIG. 4F is an enlarged view of a portion of detail F in FIG. 4E;

FIGS. 8A and 8B are top rear perspective views of an example multi-part modular detachable quiver system, depicting steps in the assembly of a first example detachable portion with example engagement members of a second example base portion, depicting for reference arrows removably stored in both portions.

Figure 1A:
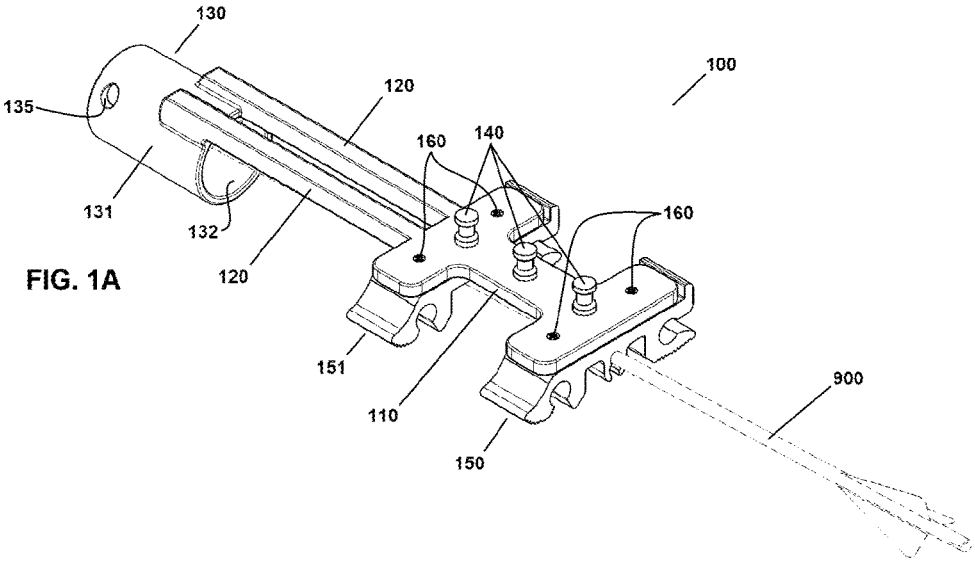
Figure 1B:
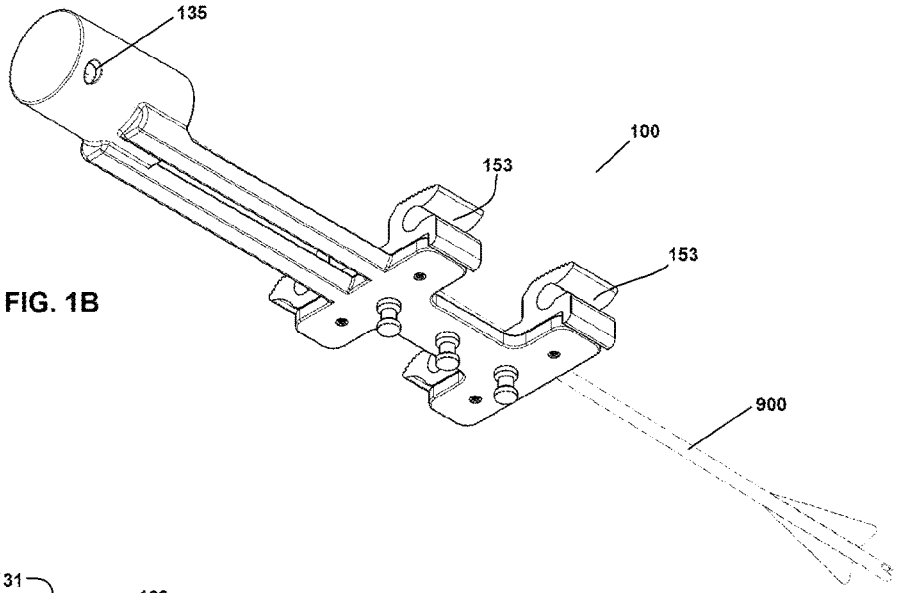
FIG. 1B is a top back side perspective view of the example base portion of FIG. 1A.

Although the figures represent example embodiments of the present disclosure, the figures might not necessarily be to scale, and certain features may be exaggerated or omitted in order to better illustrate and explain the present concepts. In the following description, like reference numbers from the figures may be used to refer to like elements and features in connection with various different embodiments.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying figures. While the invention is described in conjunction with these specific embodiments, it is understood that it is not intended to limit the invention to the described or illustrated embodiments. To the contrary, it is intended to cover alternatives, modifications, and equivalents as included within the spirit and scope of the invention as defined by any allowed claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" may be intended to include the plural forms as well as the singular forms unless the context clearly indicates otherwise. It may be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It may be further understood that terms, such as those defined in commonly used dictionaries, should be interpreted as having a meaning that may be consistent with their meaning in the context of the relevant art and the present disclosure and may not be interpreted in an idealized or overly formal sense unless expressly so defined herein.

In describing the invention, it is understood that a number of techniques and steps are disclosed. Each of these may have individual benefit and each can also be used in conjunction with one or more, or in some cases all, of the other disclosed techniques. Accordingly, for the sake of clarity, this description may refrain from repeating every possible combination of the individual steps in an unnecessary fashion. Nevertheless, the specification and claims should be read with the understanding that such combinations may be entirely within the scope of the invention and the claims.

Referring now to the drawings in detail wherein like elements are indicated by like numerals, FIGS. 1A through 8B depict example embodiments of a modular quiver system 300, comprising: a base portion 100 configured to be attachable to a bow (examples shown in the references incorporated herein by reference) and configured to removably hold a first arrow 900; and a detachable portion 200 configured to removably hold a plurality of second arrows 1000 and configured to be removably attachable with the base portion 100 by hand without the use of any tools regardless whether or not the base portion 100 is attached to the bow.

With reference to FIGS. 1A-1C and 3A-3D, in various example embodiments the base portion 100 may comprise first engagement members 150, 151 attached with fasteners 160 to a baseplate 110 (FIG. 1A). The first engagement members 150, 151 may be provided with lips 159 extending at least partially around an edge of the baseplate 110 to assist with retaining the first engagement members 150, 151 on the baseplate 110. The baseplate 110 may be connected to a first hood portion 130 by one or more longitudinally extending members 120. The first hood portion 130 may define an exterior profile 131 and an interior surface 132 configured to receive and removably retain therein an arrowhead portion 901 of the first arrow 900. With additional reference to FIGS. 3A-3C, an engagement member, such as the first engagement member 150, may be provided with flexible and resilient structures 152 which may define a smaller concavity 157 opening into a larger concavity 156, such that the smaller concavity 157 and/or larger concavity 156 are configured to deflect around and removably engage with the shaft of an arrow 900.

Figure 1C:
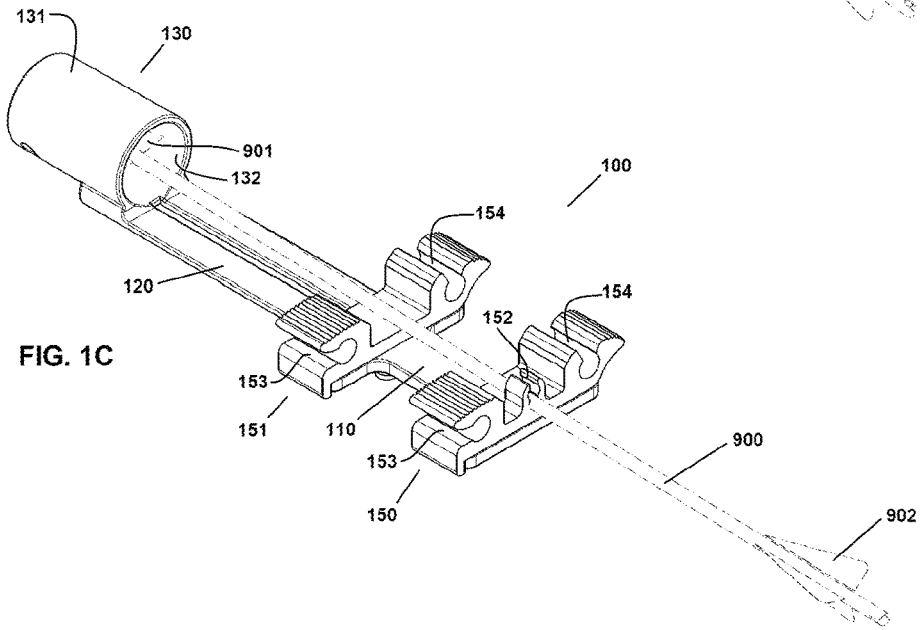
FIG. 1C is a bottom front side perspective view of the example base portion of FIG. 1A.
Figure 1F:
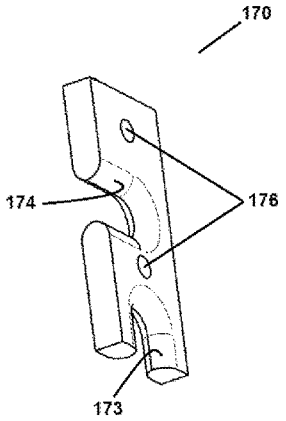
FIG. 1F is a rear perspective view of the example quick-disconnect bracket of FIG. 1D.
Figure 1D:
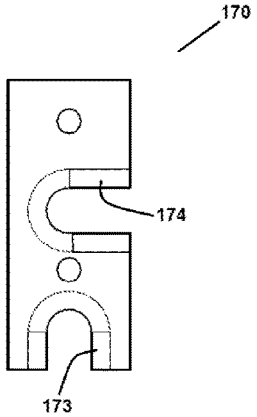
FIG. 1D is a front elevation view of an example quick-disconnect bracket configured for use with removably and selectably attaching the example base portion of FIG. 1A to a bow (not shown)
Figure 1E:
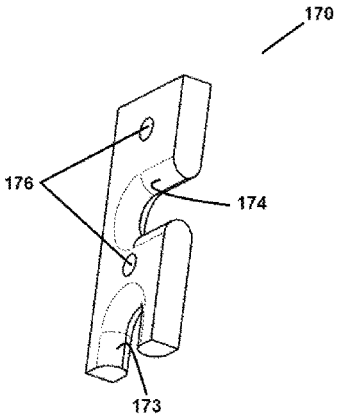
FIG. 1E is a front perspective view of the example quick-disconnect bracket of FIG. 1D.

As shown in FIGS. 1D-1F, in various example embodiments the modular quiver system 300 may further comprise a quick-release bracket 170 configured to be attached to the bow (for instance via fasteners (not shown) passing through holes 176) and configured for a user to removably engage the base portion 100 with the quick-release bracket 170 without the use of tools, regardless whether or not the detachable portion 200 is attached with the base portion 100 and regardless whether or not the base portion 100 or the detachable portion 200 or both are removably holding arrows 900, 1000. In various example embodiments the base portion 100 comprises a plurality of projections 140 (FIG. 1A) that are sized, shaped, and positioned to removably engage with slots 173, 174 in the quick-release bracket 170. In various example embodiments the modular quiver system 300 may be further configured to be selectably attached to the bow in different positions, for instance different vertical positions, depending on which of the projections 140 are removably engaged with the slots 173, 174 in the quick-release bracket 170. In various example embodiments the modular quiver system 300 may further comprise a first slot 173 in the quick-release bracket 170 extending in a first longitudinal direction (downward in FIGS. 1D, 1E, and 1F) and a second slot 174 in the quick-release bracket 170 extending in a second longitudinal direction (laterally to the left or right side in FIGS. 1D, 1E, and 1F), such that the first and second longitudinal directions are perpendicular to each other. The quick-release bracket 170 can be installed with the second slot 174 extending laterally to the left or right side (as shown in FIGS. 1D, 1E, and 1F), thereby facilitating quick-release movement by both right handed and left handed users. Persons of skill in the art will upon reviewing this disclosure readily understand that a user selectably engages two of the adjacent projections 140 with the perpendicularly-oriented slots 173, 174 in the quick-release bracket 170 by sliding one of the projections 140 into slot 173, and then rotating the base portion 100 (with or without the detachable portion 200 attached thereto) so that an adjacent projection 140 slides into the other slot 174. A close or slight interference fit may be provided between projections 140 and slots 173, 174 to cause the base portion 100 to reliably snap into place on the bow using the quick-release bracket 170.

Figure 2A:
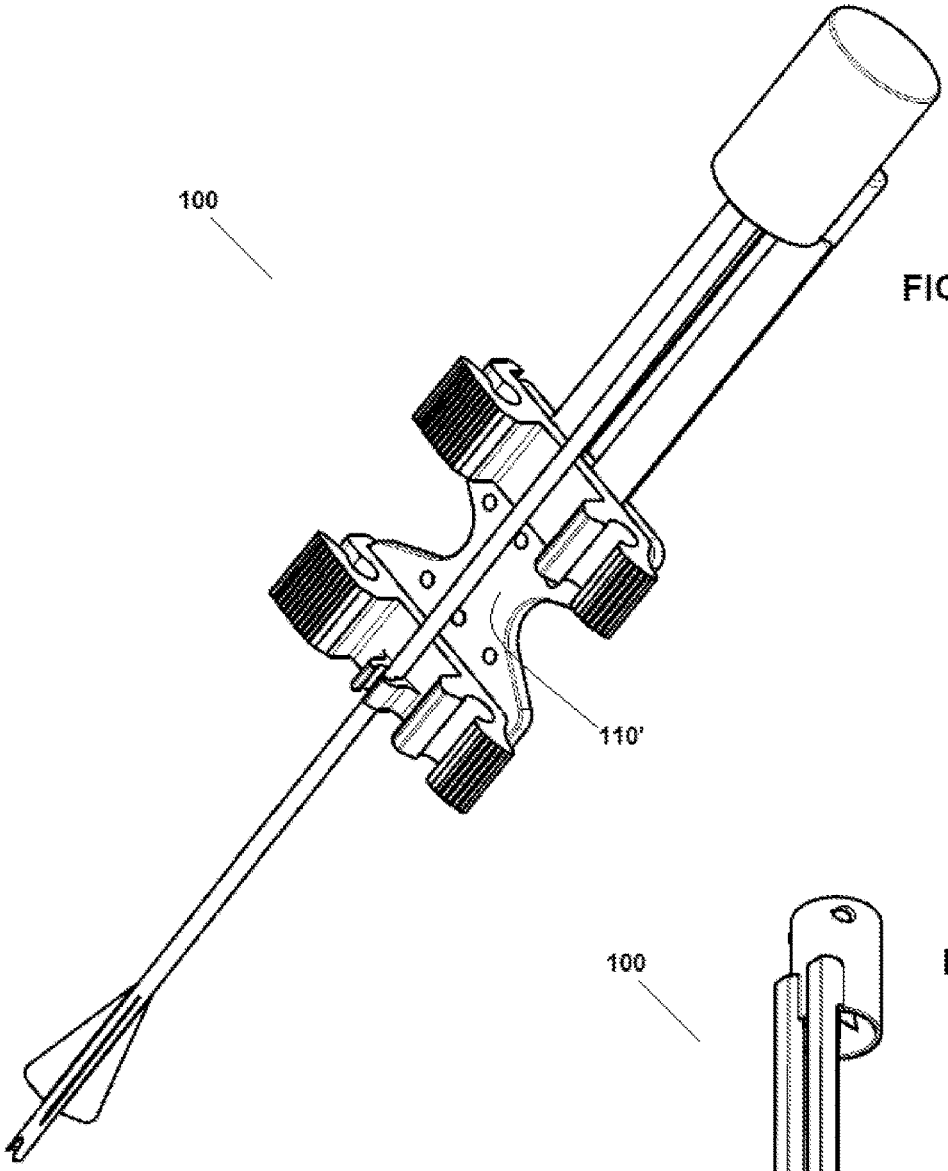
FIG. 2A is top front side perspective view of a second example base portion of a multi-part modular detachable quiver system, depicting for reference an arrow removably stored therein.
Figure 2B:
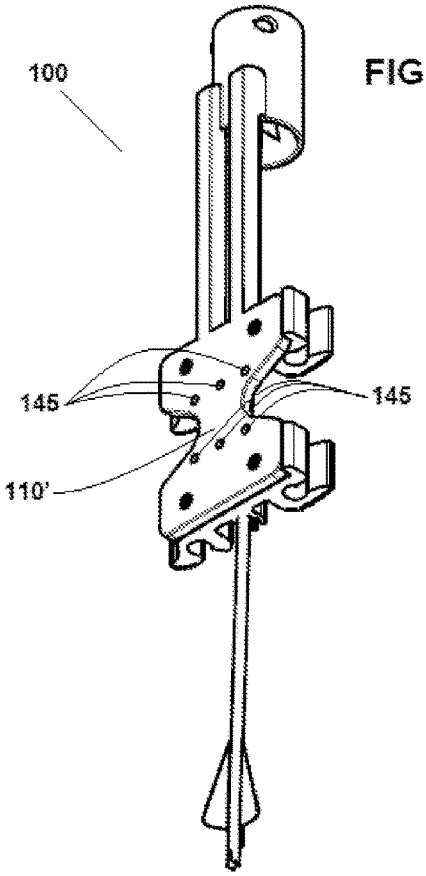
FIG. 2B is a bottom back side perspective view of the example base portion of FIG. 2A.
Figure 3A:
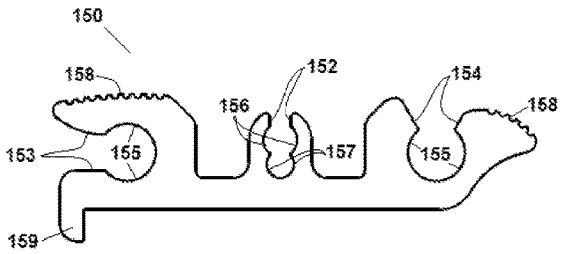
FIG. 3A is a bottom elevation view of a first example engagement member of a multi-part modular detachable quiver system according to various example embodiments.
Figure 3D:
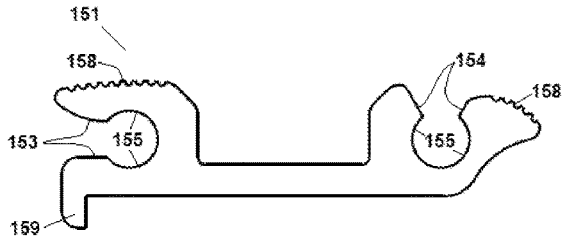
FIG. 3D is a bottom elevation view of a second example engagement member of a multi-part modular detachable quiver system according to various example embodiments.
Figure 3B:
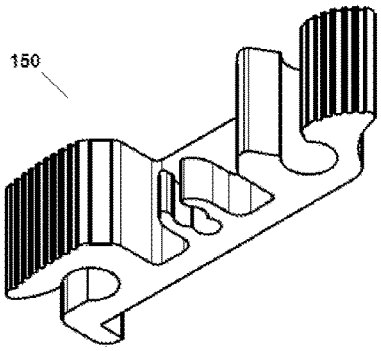
FIG. 3B is a bottom perspective view of the example engagement member of FIG. 3A.
Figure 3C:
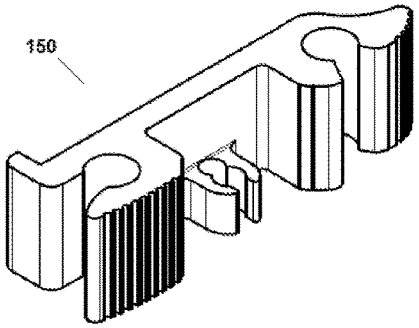
FIG. 3C is a top perspective view of the example engagement member of FIG. 3A.
Figure 5A:
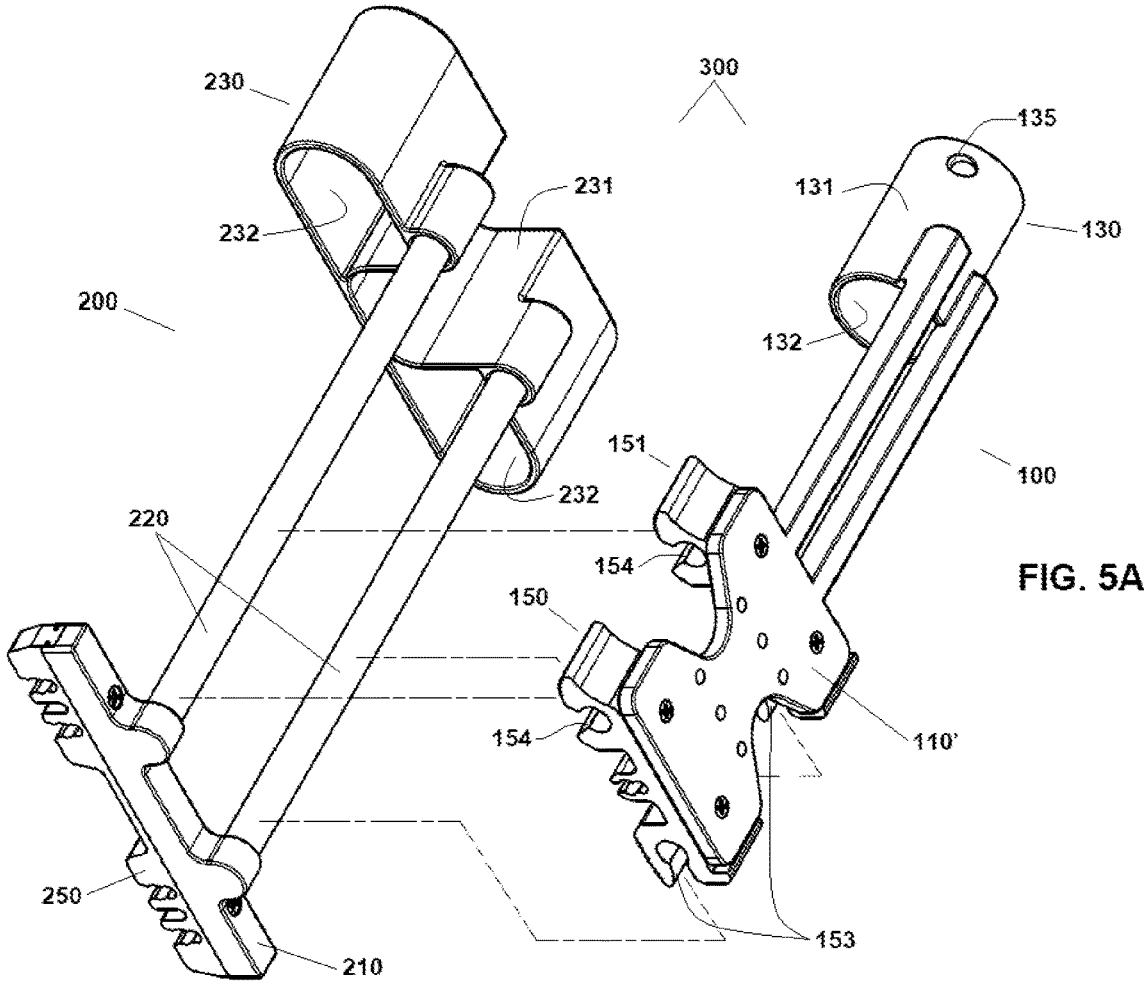
FIG. 5A is an exploded rear bottom perspective view of an example multi-part modular detachable quiver system according to various example embodiments.
Figure 5B:
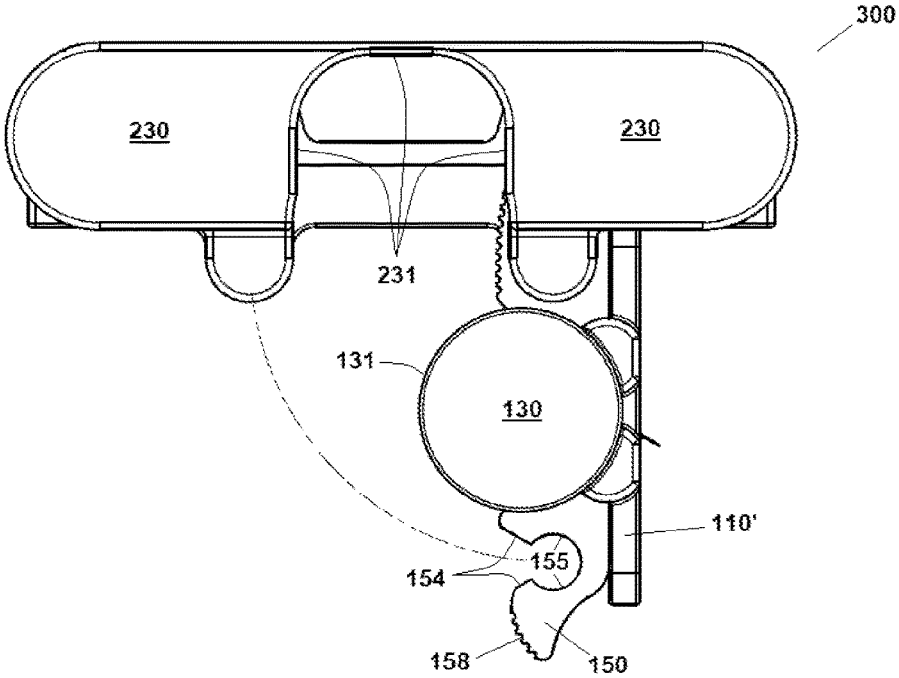
FIG. 5B is a top elevation view of the example multi-part modular detachable quiver system of FIG. 5A, depicting steps in the assembly of a first example detachable portion with an example engagement member of a second example base portion.
Figure 6A:
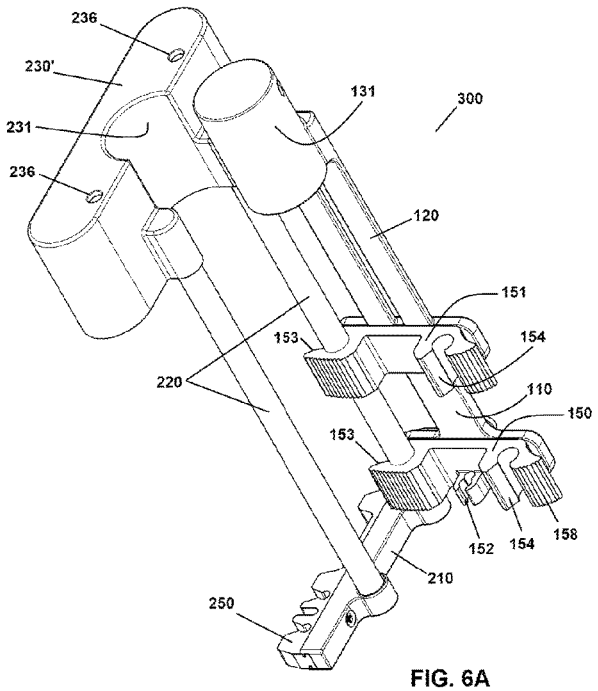
FIG. 6A is a top rear perspective view of an example multi-part modular detachable quiver system, depicting steps in the assembly of a second example detachable portion with example engagement members of a first example base portion.
Figure 6B:
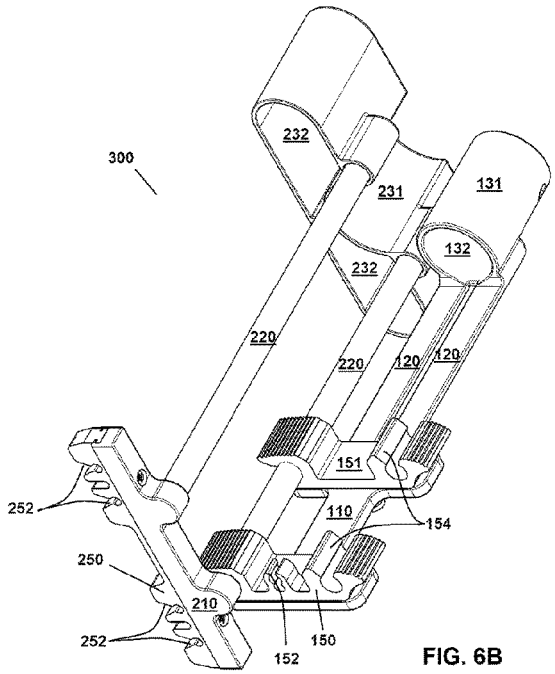
FIG. 6B is a bottom right rear perspective view of the partially assembled example multi-part modular detachable quiver system of FIG. 6A.
Figure 6C:
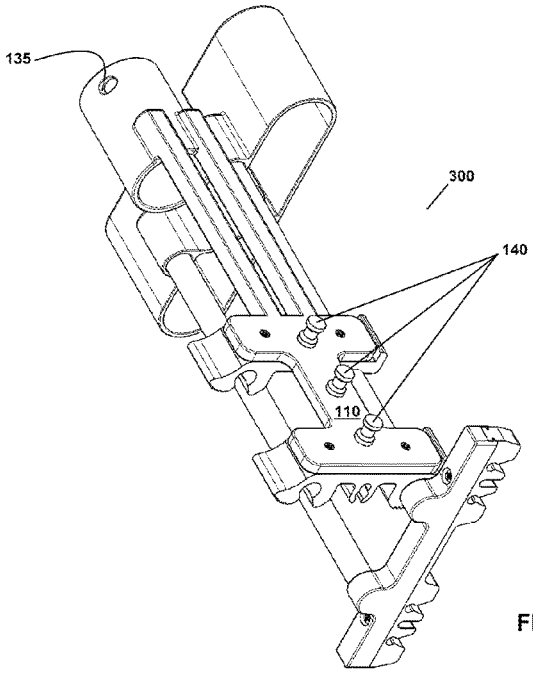
FIG. 6C is a bottom left rear perspective view of the partially assembled example multi-part modular detachable quiver system of FIG. 6A.
Figure 7A:
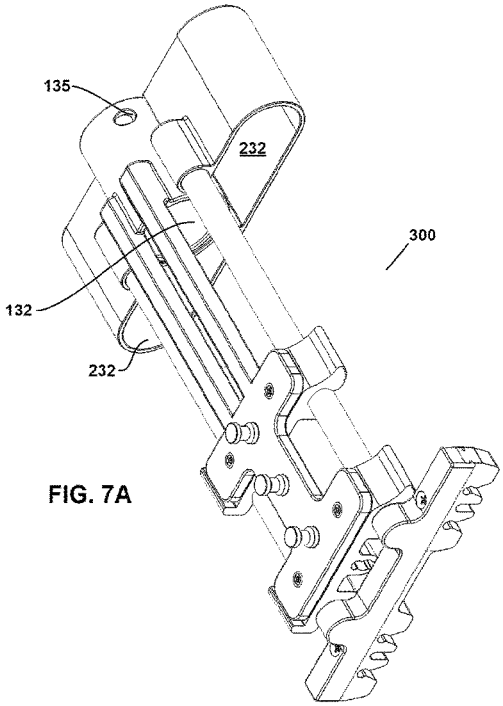
FIG. 7A is a bottom left rear perspective view of the example multi-part modular detachable quiver system of FIG. 6A, shown with the detachable portion fully assembled with the engagement members of the base portion.
Figure 7B:
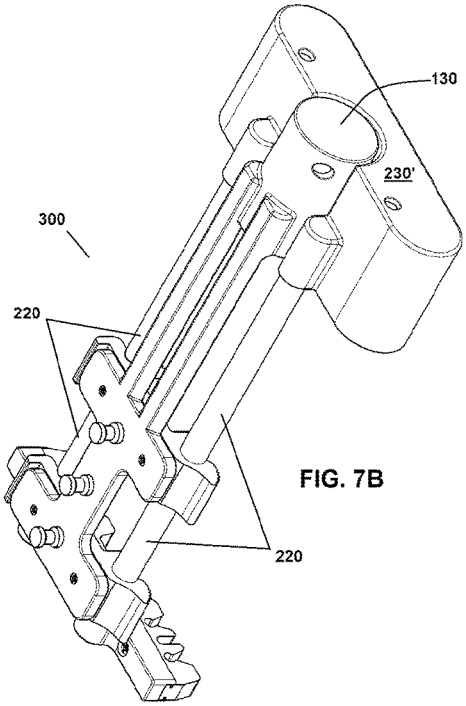
FIG. 7B is a top left rear perspective view of the quiver system assembly of FIG. 7A.
Figure 7C:
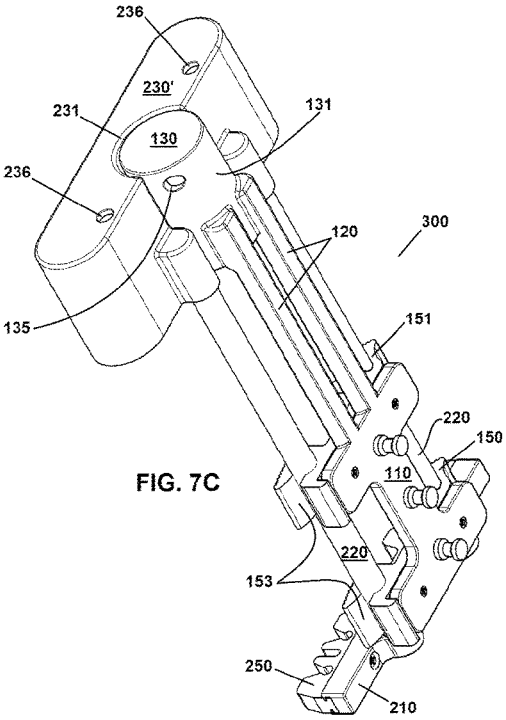
FIG. 7C is a top right rear perspective view of the quiver system assembly of FIG. 7A.
Figure 7D:
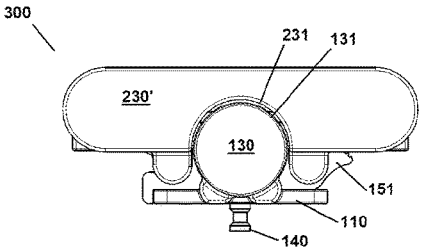
FIG. 7D is a top elevation view of the quiver system assembly of FIG. 7A.
Figure 7E:
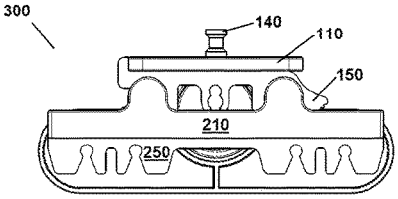
FIG. 7E is a bottom elevation view of the quiver system assembly of FIG. 7A.

An alternative baseplate 110' is shown in FIGS. 2A and 2B, which comprises holes 145 for using conventional fasteners (not shown) to attach the base portion 100 (and thus the rest of the modular quiver system 300) to the bow.

With reference to FIGS. 4A through 8B, the detachable portion 200 may comprise one or more second hood portions 230 (including for example alternative hood portion 230' in FIGS. 6A-7E) defining one or more exterior profiles 231 and one or more interior surfaces 232 configured to receive and removably retain therein arrowhead portions (not shown, but same as 901 in FIG. 1C) of the second arrows 1000. The detachable portion 200 may further comprise a lower bracket 210 supporting an arrow connection structure 250 that comprises one or more flexible and resilient structures 252 separated by gaps 259, thereby defining a plurality of smaller concavities 257 opening into larger concavities 256, such that the smaller concavities 257 and/or larger concavities 256 are configured to deflect around and removably engage with the shafts of arrows 1000. Second engagement members 220 may extend longitudinally between the one or more second hood portions 230 and the lower bracket 210.

With reference to FIGS. 5A through 8B, the first and second engagement members 150 and 151, and 220, respectively, may be configured and positioned to engage with each other in a fixed manner when pushed together by a user's hands. The first and second engagement members 150 and 151, and 220, respectively, may likewise be configured to disengage from each other when pulled apart by the user's hands. In various example embodiments the first engagement members 150 and 151 may comprise flexible and resilient structures 153 and 154, which may comprise concavities (e.g., 153 and 155, and/or 154 and 155), for instance as shown in FIGS. 3A-3D. The first engagement members 150 and 151 may be provided with gripping areas 158 to assist the user in deflecting the flexible and resilient structures 153 and 154 by hand and without the use of any tools. The first engagement members 150 and 151 may be formed from any suitable material, such as a flexible and resilient polymer, such as rubber or plastic. In various example embodiments each first engagement member 150 and 151 may comprise a first flexible and resilient concavity 153 and 155 opening toward a first longitudinal direction (e.g., to the left in FIGS. 3A and 3D) and a second flexible and resilient concavity 154 and 155 opening toward a second longitudinal direction (e.g., upward in FIGS. 3A and 3D), such that the first and second longitudinal directions are perpendicular to each other.

As shown for instance in FIGS. 4A through 4D, in various example embodiments the second engagement members 220 may comprise longitudinally extending cylindrical bars positioned correspondingly to the first engagement members 150 and 151, such that the flexible and resilient concavities (e.g., 153 and 155, and/or 154 and 155) are configured to deflect around and removably engage with corresponding ones of the longitudinally extending cylindrical bars 220.

Figure 8A:
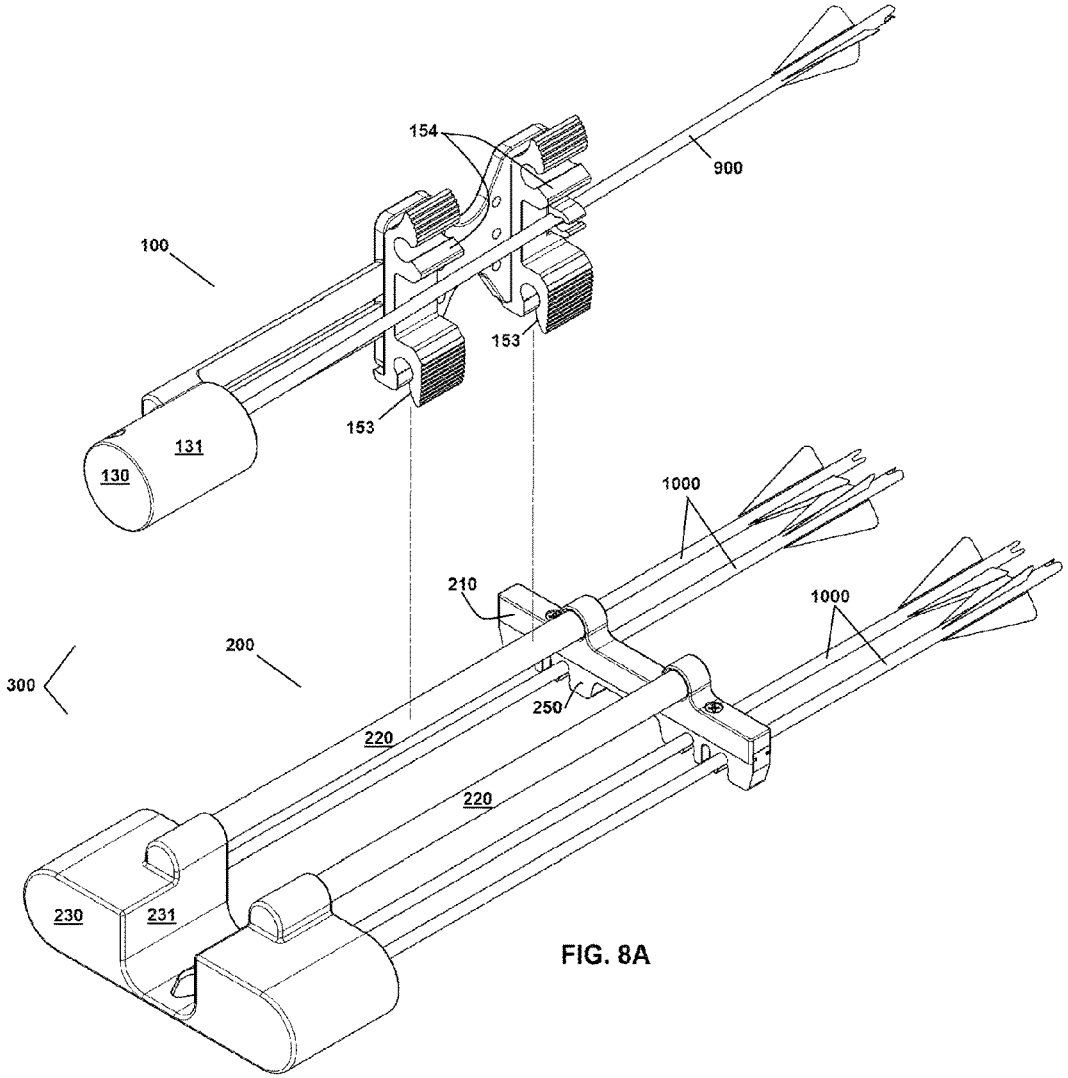
Figure 8B:
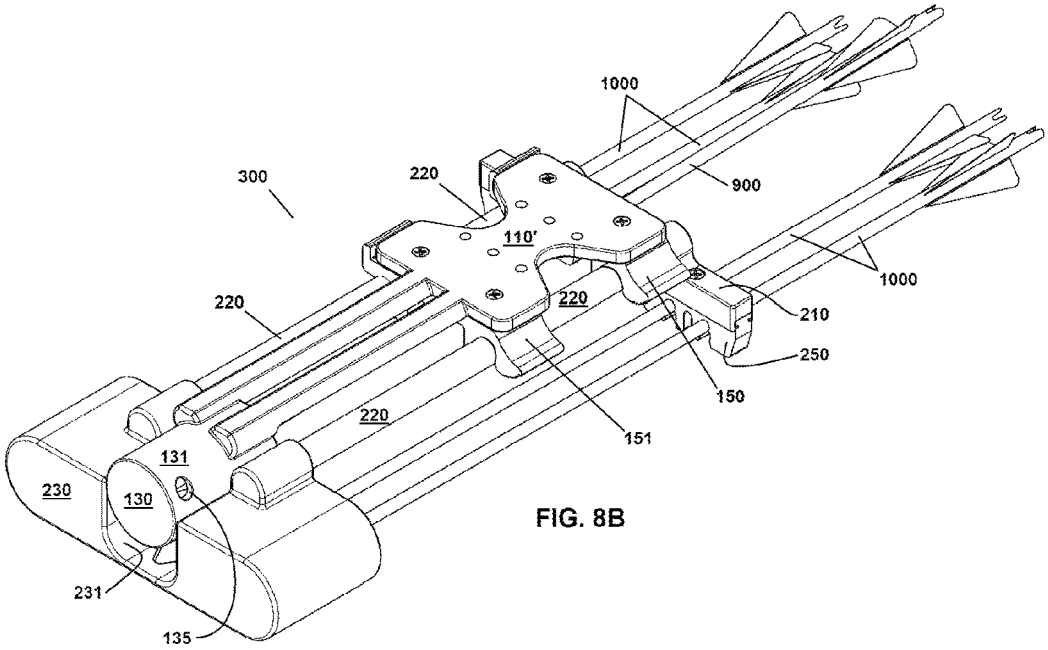

For instance, as shown in FIG. 8B, in various example embodiments the plurality of second arrows 1000 are positioned on opposite sides of the first arrow 900 when the detachable portion 200 is removably attached to the base portion 100. As shown in FIG. 1C, in various example embodiments the base portion 100 comprises a first hood portion 130 configured to receive and removably retain therein 132 an arrowhead portion 901 of the first arrow 900. As shown in FIGS. 4A-4F, the detachable portion 200 comprises one or more second hood portions 230 configured to receive and removably retain therein arrowhead portions (not shown, but same as 901 in FIG. 1C) of the second arrows 1000. For instance, as shown in FIGS. 7A through 7E and 8B, the first and second hood portions 130, 230, are sized, shaped, and positioned so that the first hood portion 130 is nested interstitially among the one or more second hood portions 230 when the detachable portion 200 is removably attached to the base portion 100 and the plurality of second arrows 1000 are positioned on opposite sides of the first arrow 900.

As shown in FIGS. 1A, 1B, 5A, 6C, 7A, 7C, and 8B, in various example embodiments the base portion 100 comprises hangable structure 135 configured sufficiently robustly to hang the bow from when the modular quiver system 300 is attached to the bow (shown in one or more references incorporated herein by reference). In various example embodiments the hangable structure 135 comprises a hole formed in a hood portion 130 of the base portion 100, the hood portion 130 configured to receive and removably retain therein 132 an arrowhead portion 901 of the first arrow 900 (FIG. 1C). As shown in FIGS. 4A and 4B, or alternatively in FIGS. 6A, 7B, and 7C, in various example embodiments the detachable portion 200 comprises hangable structure 235 and/or 236 configured sufficiently robustly to hang the bow from when the modular quiver system 300 is attached to the bow. In various example embodiments the hangable structure 235 and/or 236 comprises one or more holes formed in a hood portion 230 of the detachable portion 200, the hood portion 230 configured to receive and removably retain therein 232 arrowhead portions (not shown, but same as 901 in FIG. 1C) of the second arrows 1000. The hangable structures 135, 235, 236 may further comprise any suitable additional structure, for instance one or more hooks, ropes, loops, or other structures (not shown) engaged in or with one or more of the hangable structures 135, 235, 236.

Also provided in various example embodiments is a bow comprising a modular quiver system 300 as described herein attached thereto. While a bow is not shown in the present figures, examples of bows are shown in one or more of the references incorporated herein by reference.

Further provided in various example embodiments is a method comprising the following steps: providing a bow; providing a modular quiver system 300 as described herein; and attaching the modular quiver system 300 with the bow. With reference to FIGS. 5A through 8B, in various example embodiments the method may further comprise the steps of removing the detachable portion 200 from the base portion 100 while the base portion 100 is attached to the bow. In various example embodiments the method may further comprise the steps of removing the detachable portion 200 from the base portion 100 while the base portion 100 is attached to the bow and is removably holding a first arrow 900, and while the detachable portion 200 is removably holding a plurality of second arrows 1000, for instance as shown in FIGS. 8A and 8B. Persons of skill in the art will upon reviewing this disclosure readily understand that a user may engage the detachable portion 200 with the base portion 100 by first engaging the concavities 153 and 155 with a first one of the second engagement members 220, then rotating the detachable portion 200 relative to the base portion 100 until the concavities 154 and 155 engage with a second one of the second engagement members 220, for instance as depicted in FIGS. 8A-8B. Removal of the detachable portion 200 from the base portion 100 may be accomplished by reversing these steps.

Any of the suitable technologies, materials, and designs set forth and incorporated herein by reference may be used to implement various example aspects of the invention as could be apparent to one of skill in the art. Although exemplary embodiments and applications of the invention have been described herein including as described above and shown in the included example figures, there may be no intention that the invention be limited to these exemplary embodiments and applications or to the manner in which the exemplary embodiments and applications operate or may be described herein. Indeed, many variations and modifications to the exemplary embodiments may be possible as could be apparent to a person of ordinary skill in the art. The invention may include any device, structure, method, or functionality, as long as the resulting device, system or method falls within the scope of one of the claims that may be allowed by the patent office based on this or any related patent application.

What is claimed is:

1. A modular quiver system, comprising:

a base portion configured to be attachable to a bow and having a first hood portion and first engagement members, the first engagement members comprising flexible and resilient concavities and having an arrow engagement member disposed therebetween, the first hood portion configured to removably house a first arrow between the first engagement members with the arrowhead portion of the first arrow retained in the first hood portion and the arrow shaft retained in the arrow engagement member; and a detachable portion having at least two second hood portions defining an exterior profile therebetween sized to receive the first hood portion and second engagement members, the second engagement members comprising longitudinally extending bars, the second hood portions configured to removably house a plurality of second arrows with the arrowhead portions of the second arrows retained in the at least two second hood portions;

wherein the plurality of second arrows are positioned on opposite sides of the first arrow when the detachable portion is removably attached to the base portion;

wherein the first and second hood portions are sized, shaped, and positioned so that the entire first hood portion is nested interstitially within the exterior profile between the at least two second hood portions when the detachable portion is removably attached to the base portion;

wherein the arrow engagement member of the base portion is coplanar with the concavities of the first engagement members;

wherein the first and second engagement members are configured and positioned to engage with each other in a fixed manner when pushed together by a user's hands, such that the flexible and resilient concavities are configured to deflect around and removably engage with corresponding ones of the longitudinally extending bars, and the first and second engagement members further configured to disengage from each other when pulled apart by the user's hands.

2. The modular quiver system of claim 1, the first engagement member comprising a first flexible and resilient concavity opening toward a first longitudinal direction and a second flexible and resilient concavity opening toward a second longitudinal direction, such that the first and second longitudinal directions are parallel to each other.

3. The modular quiver system of claim 1, the base portion comprising hangable structure configured to hang the bow from when the modular quiver system is attached to the bow.

4. The modular quiver system of claim 3, the hangable structure comprising a hole formed in a hood portion of the base portion, the hood portion configured to receive and removably retain therein an arrowhead portion of the first arrow.

5. The modular quiver system of claim 1, the detachable portion comprising hangable structure configured to hang the bow from when the modular quiver system is attached to the bow.

6. The modular quiver system of claim 5, further comprising a hole formed in a hood portion of the detachable portion, the hood portion configured to receive and removably retain therein arrowhead portions of the second arrows.

7. The modular quiver system of claim 1, further comprising a quick-release bracket; wherein the base portion is attached to the bow by the quick-release bracket and wherein the quick-release bracket is configured for a user to removably engage the base portion with the quick-release bracket without the use of tools.

8. The modular quiver system of claim 7, the base portion comprising a plurality of projections sized, shaped, and positioned to removably engage with slots in the quick-release bracket.

9. The modular quiver system of claim 8 further configured to be selectably attached to the bow in different positions depending on which of the projections are removably engaged with the slots in the quick-release bracket.

10. The modular quiver system of claim 7, further comprising a first slot in the quick-release bracket extending in a first longitudinal direction and a second slot in the quick-release bracket extending in a second longitudinal direction, such that the first and second longitudinal directions are perpendicular to each other.

11. The modular quiver system of claim 1, further comprising one or more longitudinal members connecting the base portion to the first hood portion.

* * * * *